United States Patent [19]

Loughlin

[11] Patent Number: 4,766,525

[45] Date of Patent: Aug. 23, 1988

[54] LADDER BEACON

[76] Inventor: Bernard M. Loughlin, P.O. Box 385, Sayville, N.Y. 11782

[21] Appl. No.: 133,731

[22] Filed: Dec. 16, 1987

Related U.S. Application Data

[63] Continuation of Ser. No. 870,403, Jun. 4, 1986.

[51] Int. Cl.[4] ..... F21L 7/00; E06C 5/34

[52] U.S. Cl. ..... 362/183; 362/200; 362/253; 362/191; 362/802; 182/18

[58] Field of Search ..... 362/253, 802, 183, 396, 362/190, 191, 200, 267, 157, 158, 390; 441/276, 22; 182/18, 19; 260/61.45 R, 60

[56] References Cited

U.S. PATENT DOCUMENTS

| | | | |
|---|---|---|---|
| 1,694,564 | 12/1928 | Sisson | 362/396 |
| 2,502,566 | 4/1950 | Hooley | 362/396 |
| 2,893,344 | 7/1959 | Meyers | 362/102 |
| 3,953,905 | 5/1976 | Paitson | 441/22 |
| 4,311,208 | 1/1982 | Macrorie et al. | 362/253 |
| 4,460,944 | 7/1984 | Gordbegli et al. | 362/802 |
| 4,482,941 | 11/1984 | Lindner | 362/191 |

FOREIGN PATENT DOCUMENTS

| | | | |
|---|---|---|---|
| 66324 | 8/1914 | Fed. Rep. of Germany | 362/200 |
| 2081531 | 2/1982 | United Kingdom | 362/183 |

*Primary Examiner*—Ira S. Lazarus
*Assistant Examiner*—D. M. Cox
*Attorney, Agent, or Firm*—Walter G. Finch

[57] ABSTRACT

A ladder beacon is provided which will aid firefighting and rescue personnel in locating a ladder in adverse conditions such as darkness, smoke and fog. The ladder beacon is a small self contained strobe light which is affixed to the top rung of a ladder and which is automatically activated when the ladder is raised to a vertical position.

6 Claims, 2 Drawing Sheets

LADDER BEACON

This patent application is a continuation of U.S. patent application Ser. No. 870,403 filed by me on June 4, 1986, for "Ladder Beacon".

BACKGROUND OF THE INVENTION

Firefighting and rescue operations involve a multitude of risks. The use of ladders when it is dark or when there is smoke or fog presents a particular danger to firefighting and rescue personnel. Darkness, smoke and fog make it difficult to locate a ladder which may be the only escape for such personnel. Accordingly a need has existed for a device which would aid fire and rescue workers or victims of a disaster in locating their ladders quickly, in darkness, smoke or fog. Such a device must be resistant to the adverse conditions of a fire or other emergency, and must not interfere with the use of the ladder. In addition the device should be easy to install, easy to use and maintenance free.

SUMMARY OF THE INVENTION

Thus it is an object of the present invention to provide a ladder beacon which is heat resistant, impact resistant and water resistant.

It is a further object of the invention to provide a ladder beacon which is highly visible at a distance in darkness, smoke or fog.

It is yet a further object of the invention to provide a ladder beacon which is fully automated, requires no maintenance and requires no tools to install.

It is another object of the present invention to provide a ladder beacon which does not interfere with the storage, deployment or use of the ladder and which does not require installation or attention when used.

Accordingly a ladder beacon is provided in a heat water and impact resistant case. An internal gravity activated circuit automatically activates and deactivates a powerful strobe light. The case is specially adapted to be suspended from a rung on the ladder with wing nuts and/or screws or equivalent devices and is not obtrusive. The device may be powered by replaceable or rechargeable batteries and has an indicator which alerts to low voltage in those batteries.

DESCRIPTION OF THE PREFERRED EMBODIMENT

Figure 1:
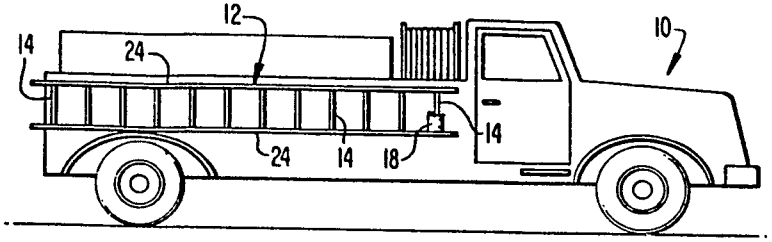
FIG. 1 shows a side elevation of a fire truck with a ladder having the ladder beacon of the present invention in place.

As seen in FIG. 1, a fire engine 10 carries a ladder 12. The ladder has rungs 14 which span the sidepieces 24. The ladder beacon 18 of the present invention is affixed to the top rung of the ladder. This is the horizontal or inoperative position.

Figure 2:
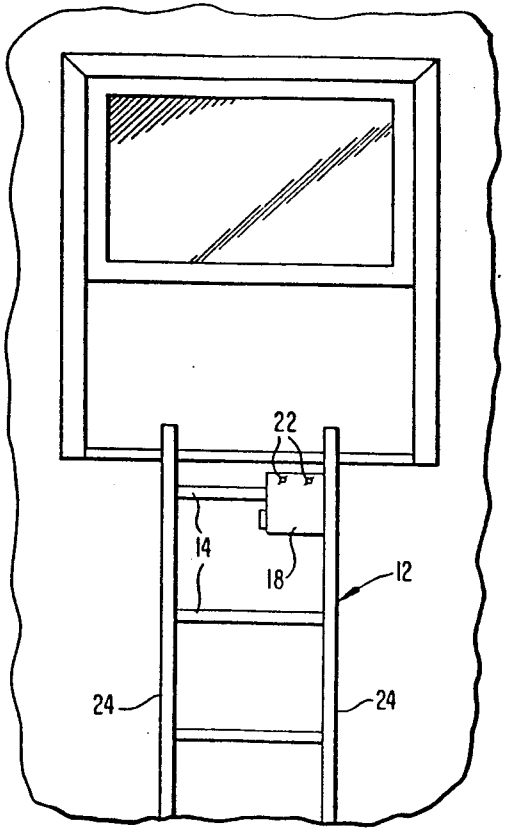
FIG. 2 is a front elevation of a window to which a ladder has been raised. The ladder is equipped with the ladder beacon of the present invention.

FIG. 2 illustrates the ladder beacon 18 in use. The top of the ladder 12 rests against a window. The top rung 14 carries the ladder beacon 18. The depth dimension of the case is not greater than the depth dimension of the ladder sidepieces. The ladder beacon 18 is firmly suspended from the top rung, adjacent one of the sidepieces. The strobe light 34 faces inwardly. Wing nuts 22 (and/or Allen head screws or equivalent devices) keep the ladder beacon 18 in place. This is the vertical position. When in the vertical position, a tilt switch 26 in the beacon case activates the strobe light 34. When activated, an internal power source provides a flash of 250,000 lumens for eight to ten hours at a strobe rate of forty to sixty flashes per minute. The case 60 is preferably constructed of high impact, heat resistant Delvin. The internal circuitry is encapsulated in a potting compound to afford further protection. When the ladder 12 is returned to a horizontal position, the tilt switch disengages, thereby deactivating the strobe light 34.

Figure 3:
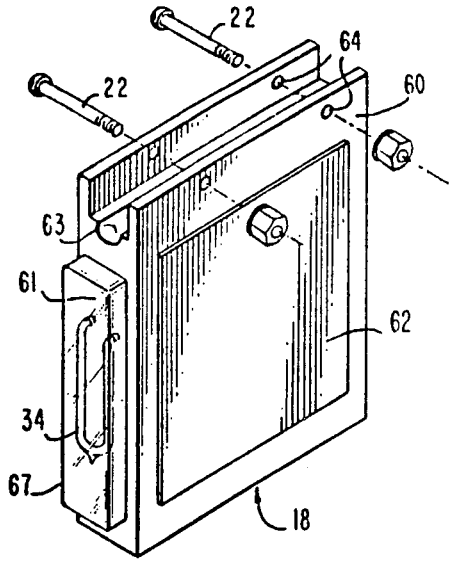
FIG. 3 is a perspective view of the ladder beacon showing the location of the strobe light and reflective panels.
Figure 4:
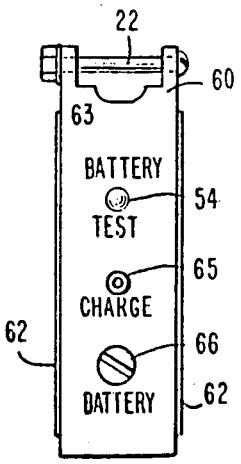
FIG. 4 is a side elevation of the ladder beacon.

FIGS. 3 and 4 show the construction of the ladder beacon 18. The Delvin case 60 has at one side a reflector 61, a powerful Xenon strobe light 34 and a transparent cover 67. The sides of the beacon 18 may be provided with reflective panels 62 on each side thereof. A channel 63 runs along the top of the unit. The channel is specially suited for snug attachment to the rung of a ladder 12. Wing nuts 22 (and/or Allen head screws or equivalent devices) traverse the channel 63 and are held by holes 64. As noted in FIG. 4, the side opposite the strobe light 34 carries a low voltage indicator light 54, a receptacle 65 for a battery charging cord and a movable cover 66 for battery replacement.

Figure 5:
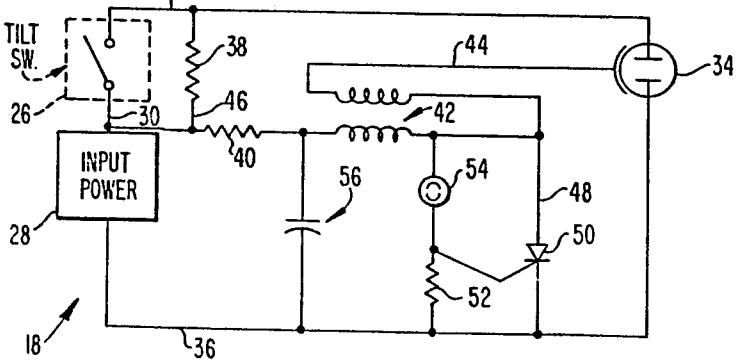
FIG. 5 is a schematic circuit diagram of the strobe and low voltage indicator portions of the present invention.

In FIG. 5, the internal circuitry is seen in a schematic. The circuitry may be imbedded in a durable potting compound to minimize the effects of water, vibration, heat and impact.

Input power 28 is in the form of one or more batteries. Any battery may be used, although a rechargeable battery is most practical. A tilt switch 26 has two positions. In the horizontal or inoperative position the tilt switch 26 is not in contact. As the ladder 12 is raised to the vertical position, the influence of gravity on the tilt switch 26 causes the completion of the circuit. This is the operative position. In the operative position a transformer 42, a capacitor 56 and resistors 38 and 40 cause the intermittent discharge of the Xenon strobe 34. A low power part of the circuit including a diode 50 and resistor 52 cause the illumination of a test bulb 54 should the battery voltage fall below a predetermined level.

Thus it will be appreciated by those with skill in the art that various modifications can be made to the ladder beacon herein disclosed without departing from the spirit of the present invention.

What is claimed is:

1. A heat resistant, impact resistant, and water resistant ladder beacon for use on a ladder, comprising, a high impact waterproof case having a top, a bottom, and four sides, means for attachment of said ladder beacon to the rung of a ladder, a strobe light means adapted to fit said high impact case, electronic means for activating and deactivating said strobe light means, with said electronic means further comprising a rechargeable power source means for providing a flash of lumens for a predetermined period of time at a predetermined strobe rate, a tilt switch means, and a low voltage indicator means having an indicator light positioned oppositely from said strobe light means and having a receptacle for a battery replacement, said tilt switch means being arranged to activate said strobe light means when said ladder is in a vertical position and to deactivate said strobe light means when said ladder is in a horizontal position, said electronic means being encapsulated in a potting compound to afford protection to said electronic means.

2. A ladder beacon as recited in claim 1, wherein said means for attachment of said light beacon to said rung of said ladder comprises a channel positioned along the top of said case, and at least one transverse fastening means for said channel.

3. A ladder beacon as recited in claim 2, wherein the depth dimension of said high impact case is no greater than the depth dimension of said sidepieces of said ladder.

4. A ladder beacon as recited in claim 3, wherein said case further comprises at least one reflective panel.

5. A ladder beacon as recited in claim 4, wherein said ladder beacon is substantially symmetrical with respect to the longitudinal direction of said ladder.

6. A ladder beacon arranged to be adapted to a ladder having rungs and sidepieces, comprising, a symmetrical high impact waterproof case having a top, a bottom and four sides, a channel extending across the top of said case, said channel having at least two through apertures adapted to receive wing nut means for mounting said case in said channel, the depth of said case being not greater than the depth of said sidepieces, an inward facing Xenon strobe light means having a reflector and a transparent cover, and a potting compound, electronic means imbedded in said potting compound for activating and deactivating said strobe light means, said electronic means further comprising a power source for providing a flash of lumens for a predetermined period of time at a predetermined time rate, a tilt switch means arranged to activate said strobe light means when said ladder is in a vertical position and to deactivate said strobe light means when said ladder is in a horizontal position, a low voltage sensing means, and a low voltage indicator light positioned oppositely from said strobe light means and having a receptacle for a battery replacement.

* * * * *